US005947338A

United States Patent [19]

Budsworth et al.

[11] Patent Number: 5,947,338

[45] Date of Patent: Sep. 7, 1999

[54] DOSING DISPENSER FOR LIQUID SOAP OR THE LIKE

[75] Inventors: Paul Budsworth; Gerrit Klaas Bunschoten; Norman Jason Pritchard, all of Maarssen, Netherlands

[73] Assignee: Diversey Lever Inc., Plymouth, Mich.

[21] Appl. No.: 08/964,098

[22] Filed: Nov. 6, 1997

[30] Foreign Application Priority Data

Nov. 19, 1996 [EP] European Pat. Off. ..... 96203231

[51] Int. Cl.[6] ..... B67D 5/06

[52] U.S. Cl. ..... 222/181.3; 222/181.2; 222/181.1; 222/494; 222/153.09

[58] Field of Search ..... 222/156, 157, 222/158, 181.1, 181.3, 181.2, 212, 494, 153.09

[56] References Cited

U.S. PATENT DOCUMENTS

| | | | |
|---|---|---|---|
| 4,164,306 | 8/1979 | Perrin | 222/181 |
| 4,457,453 | 7/1984 | Stevens et al. . | |
| 4,650,095 | 3/1987 | Tella et al. | 222/153 |
| 4,673,109 | 6/1987 | Cassia | 222/153 |
| 5,174,476 | 12/1992 | Steiner et al. | 222/181 |

FOREIGN PATENT DOCUMENTS

| | | | |
|---|---|---|---|
| 2125160 | 3/1993 | Canada . | |
| 530 789 | 3/1993 | European Pat. Off. . | |
| 3333569 | 3/1985 | Germany | 222/181.3 |
| 327 217 | 3/1985 | Switzerland . | |

*Primary Examiner*—Andres Kashnikow
*Assistant Examiner*—David Deal
*Attorney, Agent, or Firm*—Edward A. Squillante, Jr.

[57] ABSTRACT

A dosing dispenser for liquid soap, hair shampoo or similar fluids is provided, having a holder (2), releasably retaining at its two free end zones (3,4) a storage vessel (5) from which the fluid is dischargeable by way of a delivery valve of a discharge device (6), the storage vessel and discharge device connected thereto forming a replaceable refill unit, wherein the holder (2) has an inverted F—shape and is equipped with a holding sleeve (8) positioned at one of the two free end zones (3,4), locally embracing the refill unit, and forming an integral part of the holder, and wherein the replaceable refill unit is secured to the holder by means of a safeguard to prevent pilfering present in one of the free end zones.

Said dosing dispenser was found to be user-friendly and suitable for use with storage vessels of widely varying shape.

11 Claims, 4 Drawing Sheets

DOSING DISPENSER FOR LIQUID SOAP OR THE LIKE

FIELD OF THE INVENTION

The present invention relates to a dosing dispenser for liquid soap, hair shampoo or similar fluids. In particular the invention relates to a dosing dispenser having a holder releasably retaining at its two free end zones a storage vessel, from which the fluid is dischargeable by way of a delivery valve of a discharge unit.

BACKGROUND OF THE INVENTION

Various dispensers of the above-indicated kind have been described in the literature. Often, these dispensers are used as wall-mounted dosing dispensers including a flexible liquid soap containing storage vessel, which dispense aliquots of said liquid soap product when manually squeezing the bottle.

For instance, U.S. Pat. No. 4,457,453 discloses an oval squeezable container assembly including a self-sealing container closure, having a rotatable discharge device mounted over the mouth of the container. The configuration of said container assembly is such that the container can be placed in a non-operational mode by rotating the discharge device. In view of this configuration, it cannot be excluded that pilfering may occur when a container assembly proposed by U.S. Pat. No. 4,457,453 is used as a dosing dispenser.

This problem of pilfering is addressed by EP-A-530,789, which document discloses a dosing dispenser for liquid soap material, having an approximately C-shaped holder releasably retaining between its two free end zones a storage vessel, whereby the holder has at the lower of the two free end zones a holding sleeve which locally embraces the storage vessel, is detachably connected to the holder and is secured thereto by means of a safeguard to prevent pilfering.

This dispenser configuration prevents that undesired manipulation with the contents of the storage vessel can occur. As a result of this and since the storage vessel in this dosing dispenser is connected to a discharge device containing a delivery valve thus forming a replaceable refill unit, high hygienic standards can be met with this dosing dispenser.

However, the user friendliness of this dosing dispenser leaves room for improvement. When the refill unit needs to be replaced several handling steps need to be carried out:

- to place the holding sleeve around the new refill unit;
- to position the bottom of the storage vessel into the top part of the C-shaped holder; and
- to connect the holding sleeve to the holder.

It is therefore an object of the present invention to provide a dosing dispenser having a considerably improved user friendliness. It is a further object of the invention to provide a dosing dispenser which is suitable for use with storage vessels of widely varying height, shape and volume.

It has now been surprisingly found that these and other objects can be achieved when a dosing dispenser according to the present invention is used.

SUMMARY OF THE INVENTION

Accordingly, the invention provides a dosing dispenser for liquid soap, hair shampoo or similar fluids, having a holder (2), releasably retaining at its two free end zones (3,4) a storage vessel (5) from which the fluid is dischargeable by way of a delivery valve of a discharge device, the storage vessel and discharge device connected thereto forming a replaceable refill unit, wherein the holder (2) has an inverted F-shape and is equipped with a holding sleeve (8) positioned at one of the two free end zones (3,4), locally embracing the refill unit and forming an integral part of the holder, and wherein the replaceable refill unit is secured to the holder by means of a safeguard present in one of the free end zones to prevent pilfering.

DETAILED DESCRIPTION OF THE INVENTION

The configuration of the dosing dispenser of the present invention ensures that refill units having widely varying shapes can be used without being forced to change the holder.

Preferably, the holder takes the form of a holder adapted to be wall mounted. For aesthetic reasons, the design and construction of the wall-mounted holder is preferably such that the screws used to fix it to the wall are covered by the refill unit.

For reasons of user friendliness, the holding sleeve is preferably located at the lower free end zone. For the same reason, the upper free end zone is desirably equipped with a slide element. Such holder configuration enables the storage vessel to be placed into the holder by a single downward movement.

After the storage vessel has been placed into the holder it is retained therein by a locking mechanism which acts as a safeguard to prevent pilfering. This locking mechanism is desirably a snap-in connection which is outwardly concealed by the holder and/or the holding sleeve. Furthermore, this snap-in connection is preferably disconnectable only with the aid of an unlocking pin or similar operating key adapted to be passed through a guide passage of the holder to the snap-in connection. After unlocking the snap-in connection, the storage vessel is released from its retained position by pulling vertically.

In a preferred embodiment of the snap-in connection, the holding sleeve is equipped with a locking lug present in a vertical position inside said holding sleeve and having a type of snap-in tongue. When in use, the snap-in tongue of the locking lug clicks behind a rim present on the outer surface of the discharge device so as to lock the refill unit in a retaining position.

The dosing dispenser is preferably provided with a level indicator. It is in this respect desirable to apply a discharge unit made of transparent material and to use a holder sleeve located at the lower end zone of the holder and provided at the periphery thereof with at least one see-through opening, such that said opening exposes the transparent discharge unit arranged in the holder sleeve. More preferably, two see-through openings are located at the periphery of the holder sleeve, which are effectively in the form of a slit. When liquid product is visible through both the upper and the lower slit, the refill unit does not need to be replaced; however when product is only visible through the lower slit, then it is time to replace the refill unit.

The discharge unit connected to the storage vessel to form the refill unit, is preferably equipped with an automatically closing delivery valve. More preferably, at least part of the storage vessel consists of elastic material and the vessel is manually pressurisable at least in a flexible portion of its wall, whereby the delivery valve is openable by application of pressure to the wall of the storage vessel.

Most preferably, a self-sealing type of delivery valve is applied which ensures that product is only dispensed when the storage vessel wall is manually squeezed and which closes immediately after said squeezing action is stopped.

The configuration of the dosing dispenser of the invention is preferably such that a clearance is provided between the periphery of the storage vessel and the holder, permitting a hand to grip behind the storage vessel. Thus, replacement of the refill unit is facilitated.

Furthermore, the storage vessel may effectively have a flat, round or oval cross-section and at least one of the large surfaces of the vessel periphery desirably forms or has a printable outside surface.

The dosing dispenser of the invention may be made of any suitable material, such as metal, aluminum and plastic.

The invention will now be further explained by way of the preferred embodiment shown in the accompanying drawings of which:

Figure 1:
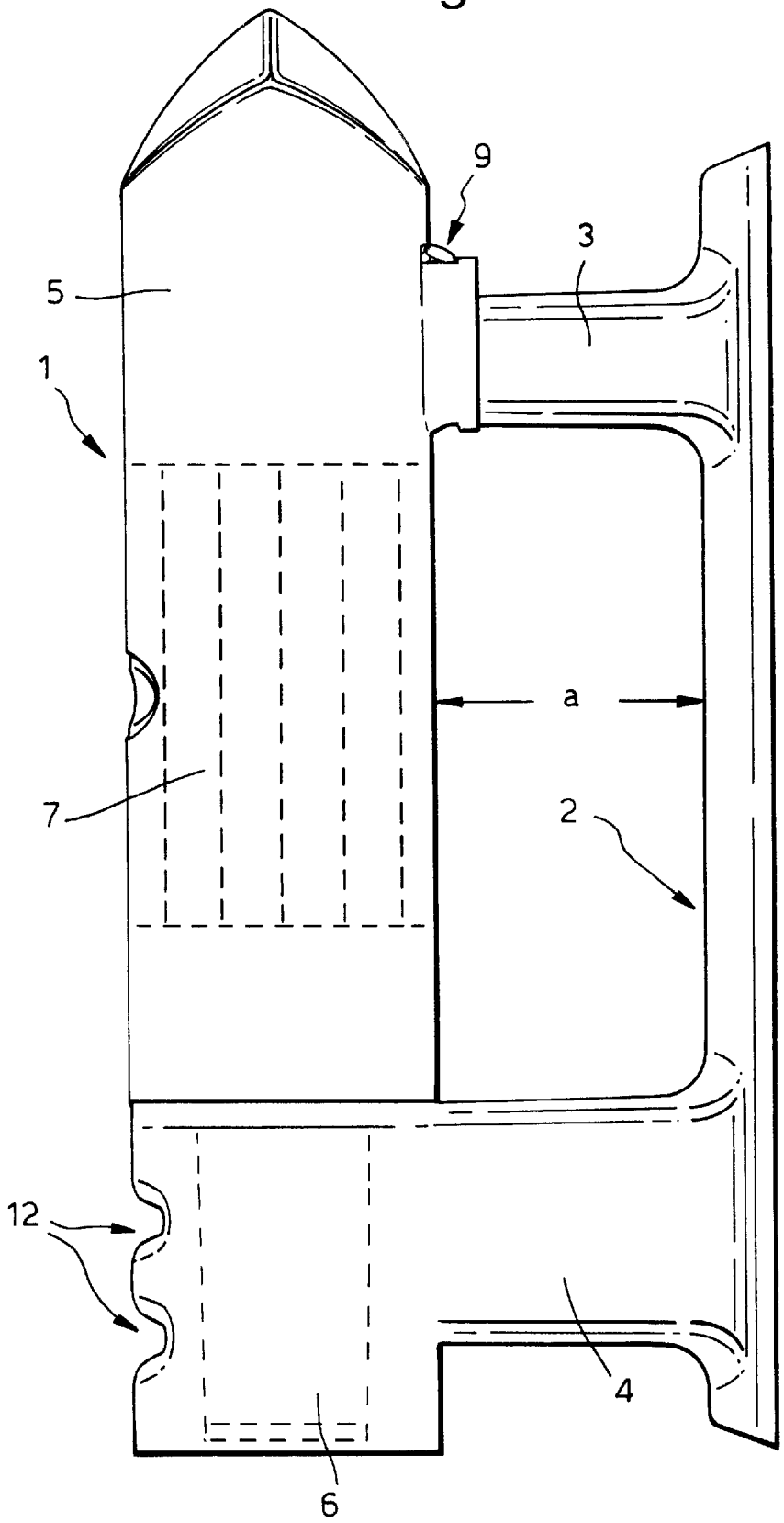
FIG. 1 shows a schematic side view of a dosing dispenser according to the invention, wherein a storage vessel is detachably retained in an inverted F-shaped holder, and wherein the vessel neck of said storage vessel is embraced by a holder sleeve which forms an integral part of the holder.
Figure 2:
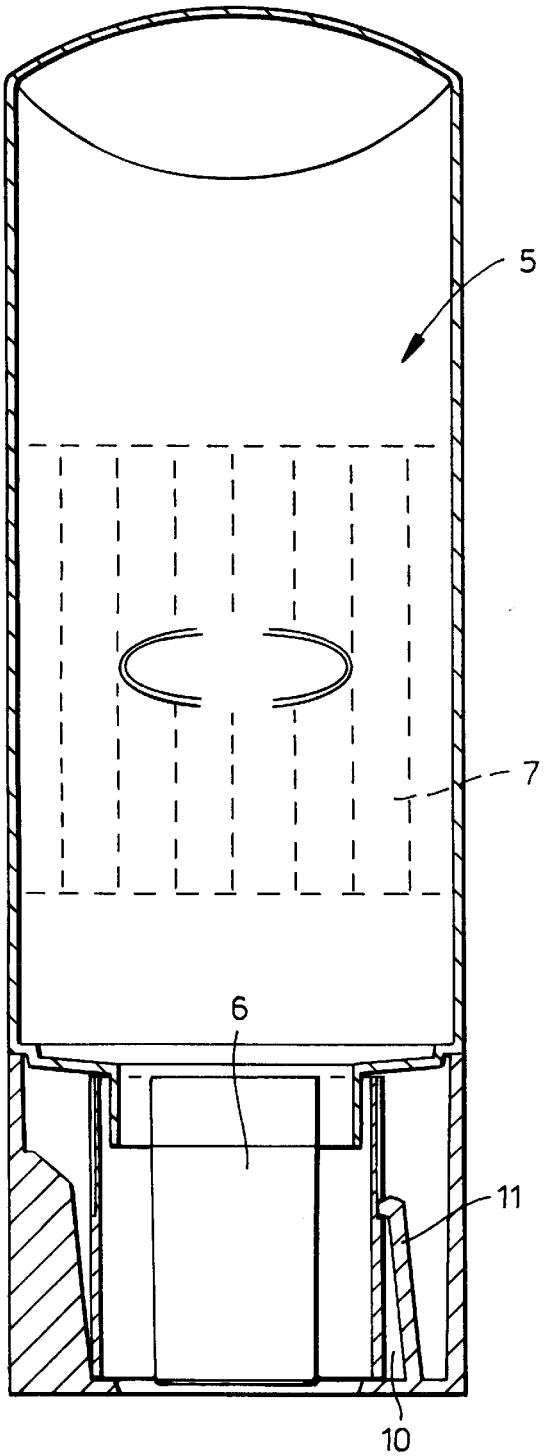
FIGS. 2 and 3 show a schematic front view respectively a schematic bottom view of said dosing dispenser.

It is noted that the views shown in FIGS. 1 and 2 are partially cross-sectional views, at the location of the holding sleeve.

In FIG. 1, a dosing dispenser (1) for liquid soaps, hair shampoo or similar fluids is shown. The dosing dispenser has an inverted F-shaped holder (2), releasably retaining at the two free end zones (3,4) of the inverted F-shape, a storage vessel (5). The fluid contained in the storage vessel is dischargeable by way of a discharge device (6). After the storage vessel (5) has been emptied, it can be disconnected from the holder (2) and replaced by a new storage vessel. In order to meet high hygienic standards, the discharge device (6) is connected with the storage vessel (5) to form a replaceable refill unit, which is releasably retained in holder (2). When replacing this refill unit, all parts of the dosing dispenser which have been in contact with the fluid discharged from the storage vessel, are replaced. Thus, fouling of the dosing dispenser is prevented. Another consequence is, that the type of liquid present in the storage vessel can be fully changed without any risk of contamination with old liquid residues.

Figure 5C:
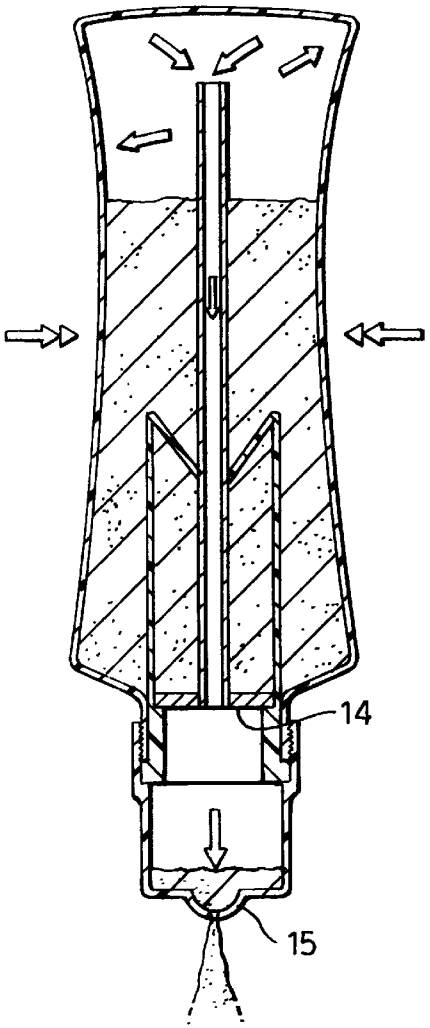
FIG. 5 shows cross-sectional views of the refill unit present in said dispenser schematically showing the effect of squeezing the storage vessel and the resulting operation of the delivery valve.
Figure 5B:
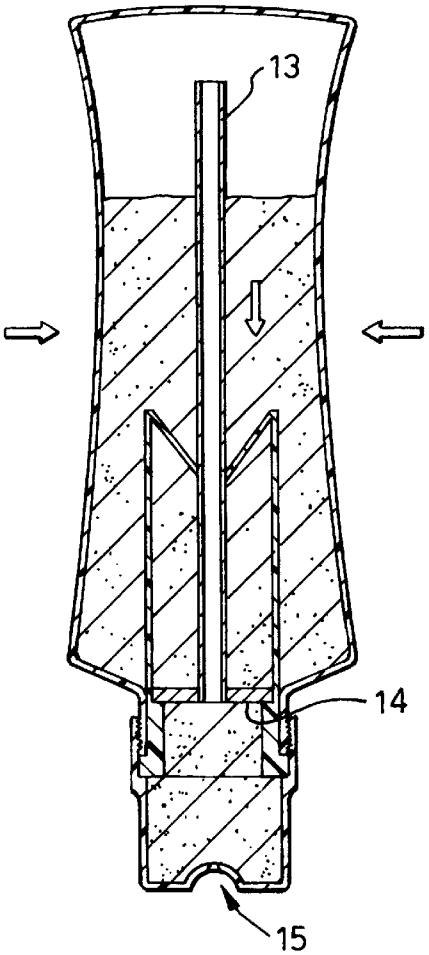
Figure 5A:
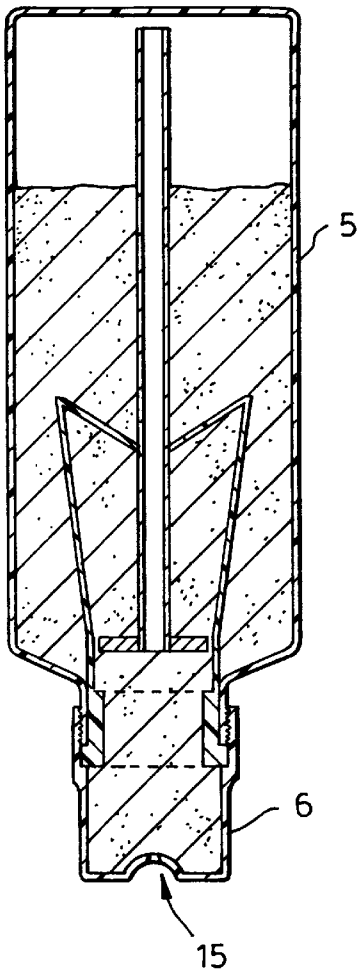

The vessel neck of the storage vessel is connected to the discharge device containing a delivery valve (see FIG. 5). The operation of said valve is dependent of the internal pressure of the storage vessel, such that it closes automatically when no pressure is exerted. A clearance (a) is provided between holder (2) and storage vessel (5), permitting a user to manually squeeze the flexible part (7) of the storage vessel wall thereby temporarily raising the internal pressure thereof and opening the delivery valve. It follows that an external pump the cleaning of which may be difficult, is not needed for discharge of the liquid contained in the storage vessel.

The lower free end zone (4) of holder (2) is provided with a holder sleeve (8) which forms an integral part of the holder (2) and embraces the discharge unit (6) containing the -not shown- delivery valve.

The upper free end zone (3) of the holder (2) is equipped with a slide element (9) so as to enable the user to place a slide guide **(9*b*) of the storage vessel (5) in to the slide element (9) in the upper free end zone (3) of the holder (2)** in a single downward movement until the storage vessel is locked in a fixed position by a snap-in connection.

This snap-in connection is located in the holding sleeve (8) and shown in a partially cross-section view, in FIG. 2. The snap-in connection which is outwardly concealed by the holding sleeve, is disconnectable only with the aid of an unlocking pin adapted to be passed through a guide passage (10).

Figure 3:
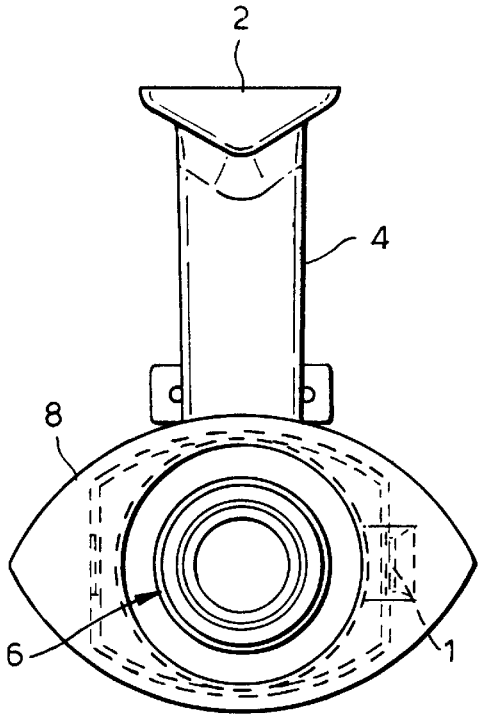
Figure 4:
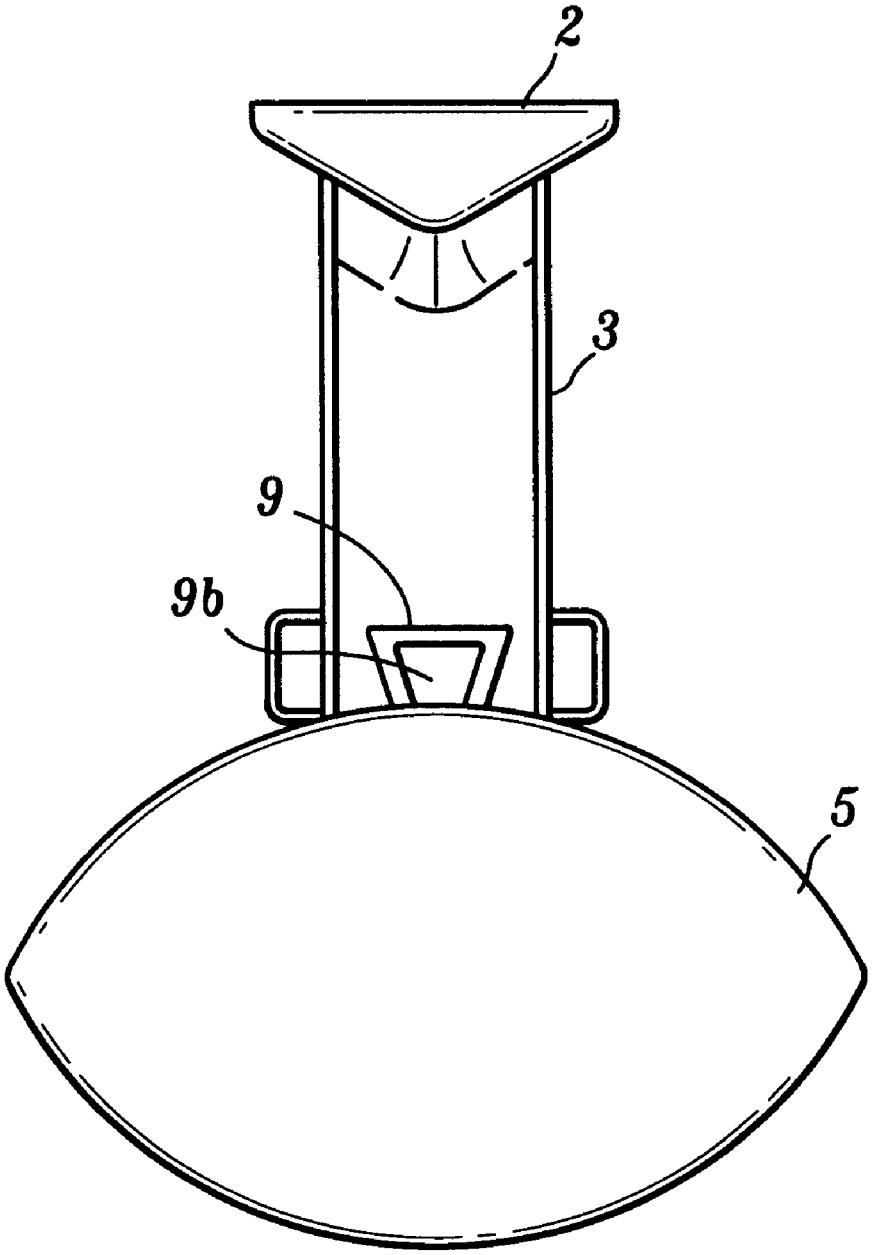
FIG. 4 shows a schematic cross-sectional view of slide element (9) present on the holder of the dispenser.

It can be further noticed in FIG. 2 that the snap-in connection comprises a locking lug (11) attached to and located in a vertical position inside the holding sleeve (8), said locking lug having a type of snap-in tongue. When in use, the snap-in tongue of the locking lug (11) clicks behind the rim present on the outer surface of the discharge device (6), which locks the refill unit in a retaining position. The refill unit can be released using an unlocking pin adapted to be passed through hole (10), which is schematically shown in FIGS. 2 and 3.

It can also be noticed in FIGS. 1 and 2 that the wall of the storage vessel (5) contains a shaded section (7). This section (7) consists of flexible elastic material which is manually pressurizable such that the automatically closing delivery valve present in the discharge unit (6) is openable by manually squeezing this section (7).

It can also be seen in FIG. 1, that the holder sleeve (8) has two see-through openings (16) in the form of a slit. The discharge unit (6) is made of transparent material, so as to enable the user of the dosing dispenser to assess the level of liquid present in the refill unit (consisting of storage vessel and discharge unit).

FIG. (4) shows a cross-sectional view of the slide element (9) present on the upper end zone (3) of the holder (2). This slide element permits smooth handling of the refill unit when placing said unit into the holder (2) of the dispenser.

In FIG. 5(*a*), a filled refill unit comprising storage vessel (5) and discharge device (6) is shown, said refill unit being ready for use. In FIG. 5(*b*), the situation is shown wherein the user starts to squeeze the wall of the storage vessel (5). As a result thereof, the pressure inside the storage vessel is raised and the stem (13) attached to the plunger (14) will start to move downward.

Upon further squeezing the storage vessel wall, the plunger (14) will push towards the liquid inside the discharge device, the delivery valve (15) will open and liquid present inside the discharge device (6) will be dosed (see FIG. 5 (c)). Upon releasing the squeezing pressure, the delivery valve (15) will immediately close and the plunger will move upward, thereby allowing the discharge device to be filled again such that the dispenser will be ready for the next dose.

When using this internal configuration of the refill unit, a constant volume of liquid will be dosed per use, said volume being dependent on the stroke of the plunger (14) and the internal diameter of the discharge device.

It is emphasized that the dispenser shown in the Figures illustrates only a preferred embodiment of the invention and that various constructional alternatives will be immediately evident to the man skilled in the art, without departing from the scope of the present invention.

We claim:

1. A dosing dispenser for liquid soap, hair shampoo or similar fluids, having a holder (2), releasably retaining at its two free end zones (3,4) a storage vessel (5) from which the fluid is dischargeable by way of a delivery valve of a discharge device (6), the storage vessel and discharge device connected thereto forming a replaceable refill unit, wherein the holder (2) has an inverted F-shape and is equipped with a holding sleeve (8) positioned at one of the two free end zones (3,4), locally embracing the refill unit, and forming an integral part of the holder, and wherein the replaceable refill unit is secured to the holder by means of a safeguard present in one of the free end zones to prevent pilfering.

2. A dosing dispenser according to claim 1 wherein the holding sleeve (8) is located at the lower free end zone (4) and wherein the upper free end zone (3) of the holder (2) is equipped with a slide element (9), so as to enable the slide guide (9*b*) of the storage vessel (5) to be placed into the holder (2) in a single downward movement.

3. A dosing dispenser according to claim 1, wherein the storage vessel (5) is detachably retained in the holder by means of a snap-in connection (11), wherein said snap-in connection is outwardly concealed by the holding sleeve (8) and wherein the snap-in connection is disconnectable only with the aid of an unlocking pin or similar operating key adapted to be passed through a guide passage (10) of the holding sleeve (8).

4. A dosing dispenser according to claim 3, wherein the snap-in connection comprises a locking lug (11) located in a vertical position inside the holding sleeve (8), and wherein said locking lug (11) carries or has a snap-in tongue which clicks behind a rim present on the outer surface of the discharge device (6), so as to keep the refill unit in a retained position.

5. A dosing dispenser according to claim 1, wherein the dispenser (1) is provided with a level indicator.

6. A dosing dispenser according to claim 5, wherein the discharge device (6) is made of transparent material and wherein at least one see-through opening (12) is provided at the periphery of the holding sleeve (8), which opening exposes the transparent discharge device arranged therein.

7. A dosing dispenser according to claim 1, wherein the storage vessel (5) is connected to a discharge device (6) equipped with an automatically closing delivery valve.

8. A dosing dispenser according to claim 1, wherein at least part of the storage vessel (5) consists of elastic material, wherein the vessel is manually pressurizable at least in a flexible portion (7) of its wall, and wherein the delivery valve is openable by application of pressure to the wall of the storage vessel.

9. A dosing dispenser according to claim 1, wherein a clearance (a) is provided between the periphery of the storage vessel (5) and the holder (2), permitting a hand to grip behind the vessel.

10. A dosing dispenser according to claim 1, wherein the holder (2) takes the form of a holder adapted to be wall-mounted.

11. A dosing dispenser according to claim 1, wherein the refill unit is equipped with a plunger (14) and the bottom side of the discharge device contains an automatically closing delivery valve (15), so as to obtain a constant dosage per use.

* * * * *